US008581493B2

(12) United States Patent
Howell et al.

(10) Patent No.: US 8,581,493 B2
(45) Date of Patent: Nov. 12, 2013

(54) CERAMIC ELECTRODE FOR A HIGH-PRESSURE DISCHARGE LAMP

(75) Inventors: Philip Clissold Howell, Riemerling (DE); Andreas Kloss, Neubiberg (DE); Gia Khanh Pham, Charlotte, NC (US); Steffen Walter, Oberpframmern (DE); Raquel de la Pena Alonso, Munich (DE)

(73) Assignee: OSRAM AG, Munich (DE)

( * ) Notice: Subject to any disclaimer, the term of this patent is extended or adjusted under 35 U.S.C. 154(b) by 0 days.

(21) Appl. No.: 13/515,825

(22) PCT Filed: Nov. 10, 2010

(86) PCT No.: PCT/EP2010/067173
§ 371 (c)(1),
(2), (4) Date: Jun. 14, 2012

(87) PCT Pub. No.: WO2011/085839
PCT Pub. Date: Jul. 21, 2011

(65) Prior Publication Data

US 2012/0262051 A1 Oct. 18, 2012

(30) Foreign Application Priority Data

Dec. 22, 2009 (DE) ..... 10 2009 055 123

(51) Int. Cl.
*H01J 17/16* (2012.01)

(52) U.S. Cl.
USPC ..... 313/634; 313/574

(58) Field of Classification Search
USPC ..... 313/574, 634
See application file for complete search history.

(56) References Cited

U.S. PATENT DOCUMENTS

| | | | | |
|---|---|---|---|---|
| 5,874,805 | A | 2/1999 | Kavanagh | |
| 6,218,025 | B1 | 4/2001 | Fromm et al. | |
| 6,232,718 | B1 | 5/2001 | Johnston et al. | |
| 2003/0034735 | A1 | 2/2003 | Rausenberger et al. | |
| 2004/0140767 | A1 * | 7/2004 | Gilles | 313/574 |
| 2011/0248028 | A1 | 10/2011 | Huettinger et al. | |

FOREIGN PATENT DOCUMENTS

| | | | |
|---|---|---|---|
| EP | 0467713 | A2 | 1/1992 |
| EP | 0643416 | A1 | 3/1995 |
| EP | 0964429 | A1 | 12/1999 |
| EP | 1065697 | A2 | 1/2001 |
| EP | 0835519 | B1 | 6/2002 |
| EP | 1265264 | A2 | 12/2002 |
| GB | 731421 | A | 6/1955 |
| JP | 63019750 | A | 1/1988 |
| JP | 1086439 | A | 3/1989 |
| JP | 10083792 | A | 3/1998 |
| JP | 10208694 | A | 8/1998 |
| WO | 9736311 | A1 | 10/1997 |
| WO | 2010069678 | A2 | 6/2010 |

OTHER PUBLICATIONS

English Abstract of JP1086439 A. Mar. 31, 1989.
English Abstract of JP63019750 A. Jan. 27, 1988.
English Abstract of JP10083792 A. Mar. 31, 1998.
English Abstract of JP10208694 A. Aug. 7, 1998.

* cited by examiner

*Primary Examiner* — Mary Ellen Bowman

(57) ABSTRACT

An electrode for a high-pressure discharge lamp may include a shaft and a head mounted thereon, wherein at least a section of the head includes ceramic material, wherein the ceramic material is a boride or carbide.

6 Claims, 3 Drawing Sheets

CERAMIC ELECTRODE FOR A HIGH-PRESSURE DISCHARGE LAMP

RELATED APPLICATIONS

The present application is a national stage entry according to 35 U.S.C. §371 of PCT application No.: PCT/EP2010/067173 filed on Nov. 6, 2010, which claims priority from German application No.: 10 2009 055 123.9 filed on Dec. 22, 2009.

TECHNICAL FIELD

Various embodiments relate to a ceramic electrode for a high-pressure discharge lamp.

BACKGROUND

An electrode made from $LaB_6$ is known from patent application publication JP 1 086 439.

An electrode coated with $LaB_6$ is known from patent application publication JP 63-019750.

Metal-based sinter electrodes as such are already known from U.S. Pat. No. 6,218,025.

Ceramic electrodes using nitridic or oxidic material are already known from U.S. Pat. No. 6,232,718 and EP 1265 264.

A ceramic electrode which is embodied as a layer and formed from $LaB_6$ or $CeB_6$ is known from PCT/EP2009/064961. A layer electrode of said type is produced by means of LTTC.

SUMMARY

Various embodiments provide a ceramic electrode for a high-pressure discharge lamp which has a low electron work function.

The novel ceramic electrode according to the invention is an electrode which has a shaft and a head fixedly mounted thereon. The head is embodied in particular in the shape of a cylinder or similar.

In this case the head is formed either completely or in its outer layer from boride. Particularly suitable candidates for this are the per se known $LaB_6$ or borides of Ce, Y and Yb. Materials of said type are in fact well-known in lamp manufacture, though in most cases as an electron-emissive layer. The possibility of forming a solid body therefrom has never before been considered in the prior art.

The per se known sol-gel process is suitable as a fabrication process for producing a coating made from ceramic material.

Borides of La, Ce, Y and Yb have relatively high melting points, a property which is important for an electrode. The melting point lies in the range of 2500 to 2600° C. At the same time the electron work function is relatively low; see Tab. 1.

TABLE 1

| Material | Chemical formula | Melting point | Work function |
|---|---|---|---|
| Lanthanum boride | $LaB_6$ | 2500-2600° C. | 2.14 eV |
| Yttrium boride | YB6 | 2600° C. | 2.22 eV |
| Cerium boride | CeB6 | 2550° C. | 2.60 eV |
| Ytterbium boride | YbB6 | 2550° C. | 3.13 eV |

These materials can be utilized for the head as a solid ceramic material or ceramic layer. Other materials are also suitable as a coating; these are listed in Tab. 2.

TABLE 2

| Material | Chemical formula | Melting point | Work function |
|---|---|---|---|
| Tantalum carbide | TaC | 3800° C. | 4.36 eV |
| Hafnium carbide | HfC | 3890° C. | 3.69 eV |
| Ta—Hf carbide | (Ta0.9Hf0.1)C | >4000° C. | 2.54 eV |
| Ta—Hf carbide | (Ta0.8Hf0.2)C | >4000° C. | 2.90 eV |

The materials concerned here are carbides of Ta and/or Hf, the best results being achieved with a mixture composed of both carbides, in which case the proportion of Hf should lie in the region of 10 to 20 mol %, since it is here that on the one hand the lowest work function is achieved and on the other hand the highest melting point is realized.

Typical layer thicknesses for ceramic layers of said type lie in the range from 1 to 100 μm.

It is also possible in particular to utilize a plurality of layers consisting of different materials, in which case the material having the low work function in particular should be disposed at the surface.

According to the prior art, hollow ceramic bodies, in most cases composed of Al2O3 (PCA), are employed for the discharge vessel of a high-pressure discharge lamp. They are mostly manufactured by means of low-pressure injection into a suitable mold. Two thus fabricated half-shells to which capillary tubes are attached are green-welded to each other and then sintered so as to produce a gas-tight seal. The electrode systems are fused into the capillary tubes by means of glass solder after the introduction of a fill, in most cases one containing metal halides.

Conventionally, the electrode heads are fabricated from metal that has the highest possible melting point. Tungsten, which has an electron work function of 4.54 eV, is a suitable candidate. The temperature at the electrode tip reaches approx. 3100 K during operation.

Typically, the discharge vessel is provided with electrodes. One or two electrodes can be used. On their head these can be coated with a layer, preferably consisting of LaB6, over their entire surface area.

Preferably the head of the electrode has a substantially rounded or tapered shape.

In Tab. 3, important properties of already known implementations of electrodes and embodiments of electrodes according to the invention are compared with one another, based on tungsten and LaB6 by way of example.

| Material | Tungsten | $LaB_6$ |
|---|---|---|
| Melting temperature | 3410° C. | 2500-2600° C. |
| Work function | 4.54 eV | 2.14 eV |
| Thermal conductivity | 170 W/mK | 47 W/mK |
| Coefficient of thermal expansion | $4.7 \times 10^{-6}$/K | $6.2 \times 10^{-6}$/K |

The approx. 2 eV lower work function of $LaB_6$ compared with tungsten leads to an experimentally determined reduction in temperature at the tip of the electrode by approx. 1300 K compared with tungsten, for which the typical value is 3100 K.

This leads to comparable vaporization rates as in the case of tungsten, though on account of the lower thermal conductivity and the lower operating temperature significantly smaller thermal losses are incurred, which is synonymous with higher efficiency. This results in turn in a reduction in the amount of energy introduced into the feedthrough, in particular due to waste heat.

The lower working or operating temperature, combined with the fact that $LaB_6$ has a much higher coefficient of thermal expansion than tungsten, being significantly closer to that of Al2O3 (PCA has 8.3 10−6/K), gives rise to the possibility of designing lamps that are much shorter in length, because the length of the capillary tubes can be reduced. A further positive effect associated therewith results in a reduced clearance volume.

This in turn leads to lower color dispersion and a longer useful life.

An additional factor is that a material such as $LaB_6$ is corrosion-resistant to rare earth iodides as part of the fill. The useful life is extended further as a result.

All in all, therefore, advantages are produced as a result of the lower operating temperature, reduced thermal losses, higher efficiency, saving in terms of electrical energy, low color dispersion, higher reliability, and high resistance to corrosion.

In particular a mercury-free fill can be employed.

A real-world method for applying a coating is the per se known sol-gel process. The production of carbides of Ta and/or Hf makes it possible to apply thin coatings of per se highly heat-resistant base bodies made from metals such as tungsten. During said process the base bodies made e.g. from tungsten, etc. can be immersed in solutions of precursors, which then lead to the formation of the carbides. The solution which ultimately, following transformation of the precursor, contains (Ta,Hf)C, for example, can then gel at the head after leaving the immersion bath and cure, where applicable assisted by application of heat. In this final step the electrode heads are pyrolyzed in an oven at temperatures between 1800 and 2100° C. and the coating is permanently bound to the base body.

Furthermore, as an alternative, solid ceramic bodies can also be produced from coating materials of said type. Fibers can also be drawn and then processed further to form ceramic.

This affords many possibilities for configuring the geometry of the electrodes.

A cost-effective coating process is accordingly available. The same can be integrated into the existing production line without additional outlay.

The application of a sol-gel process permits a wide variability in the layer thickness from a few nm to some tens of μm. Furthermore, it is even possible to produce solid ceramic bodies therewith. In particular it is also possible to produce fibers from a material such as (Ta0.9Hf0.1)C.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DECRIPTION

The following detailed description refers to the accompanying drawings that show, by way of illustration, specific details and embodiments in which the invention may be practiced.

Figure 1:
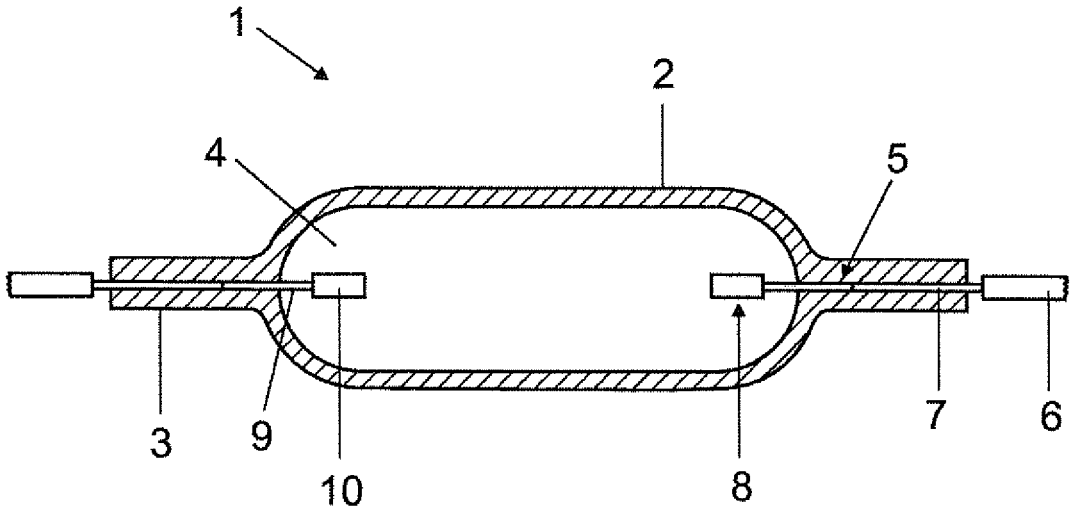
FIG. 1 shows a discharge vessel having two electrodes.

FIG. 1 shows a ceramic discharge vessel 1 having a cylindrical central part 2 and two capillary tubes 3. A fill composed of metal halides is introduced into the cavity 4 of the central part.

An electrode system 5 is sealed off in the capillary tube 3 by means of glass solder in each case. The electrode system 5 has an external current infeed 6, a feedthrough 7 and an electrode 8. The electrode has a shaft 9 and a head 10.

Figure 2:
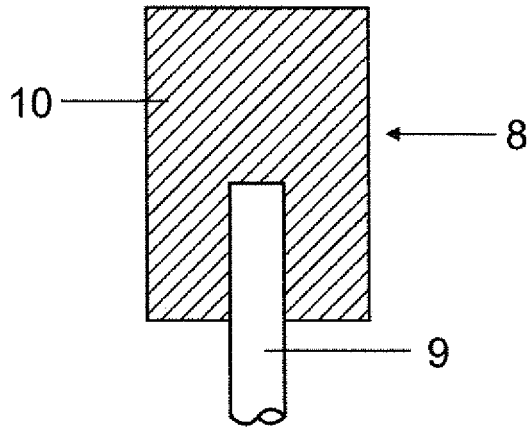
FIG. 2 shows an electrode having a ceramic head.

FIG. 2 shows an electrode 8 in detail. It has a shaft 9 made from tungsten on which sits a cylindrical head 10 made from $LaB_6$. The head is made of ceramic.

Figure 3:
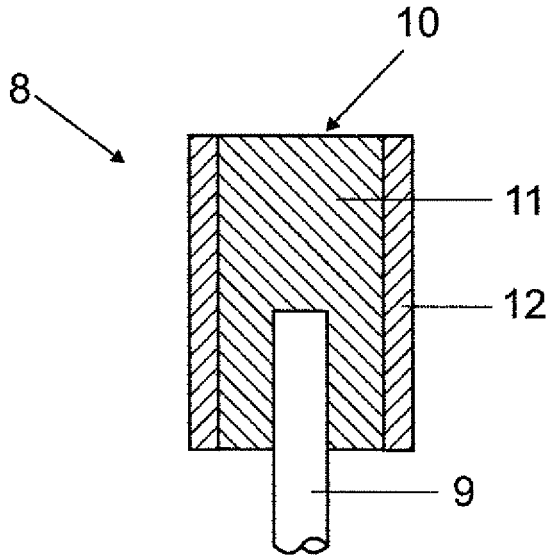
FIG. 3 shows an electrode as a solid body.

FIG. 3 shows a second exemplary embodiment of an electrode 8. In this case the head 10 is constructed from a base body 11 which is made from tungsten and is encapsulated on the outside by a ceramic layer 12 made from $YB_6$. Alternatively, $Ta_{0.9}Hf_{0.1}C$ in particular is used here.

Figure 4:
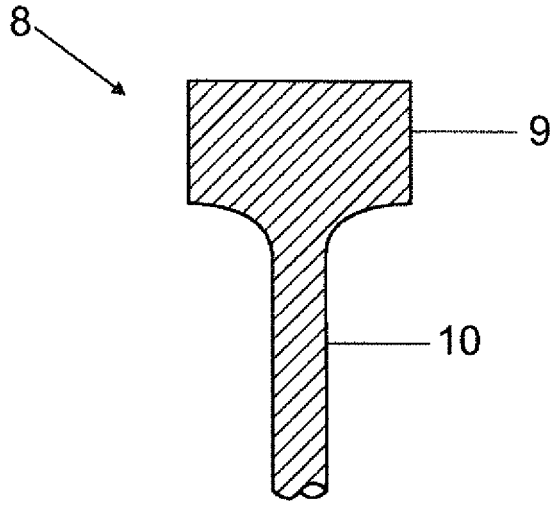
FIG. 4 shows an electrode having a coating in a rounded shape.

FIG. 4 shows an exemplary embodiment in which the entire electrode 8, head 9 and shaft 10 are fabricated from a ceramic material, specifically TaC.

Figure 5:
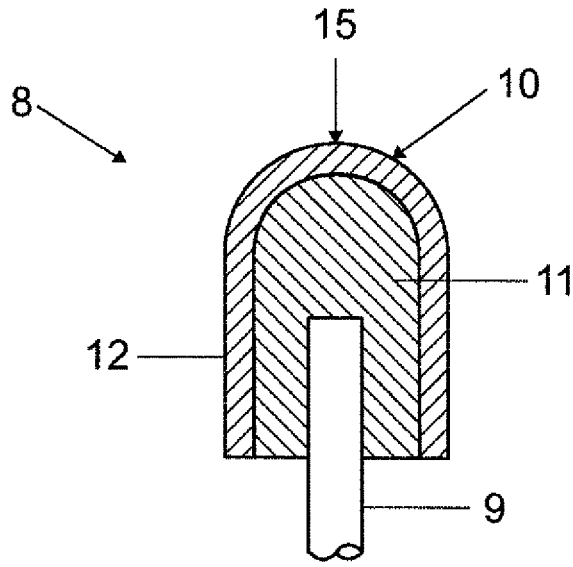
FIGS. 5 and 6 show an electrode having a coating in a tapered shape.

FIG. 5 shows an electrode 8 in which the head 10 consists of base body 11 and outer layer 12. The base body 11 is cylindrical and has a rounded tip 15. The head is covered on the discharge side with a layer 12 made from $CeB_6$.

Figure 6:
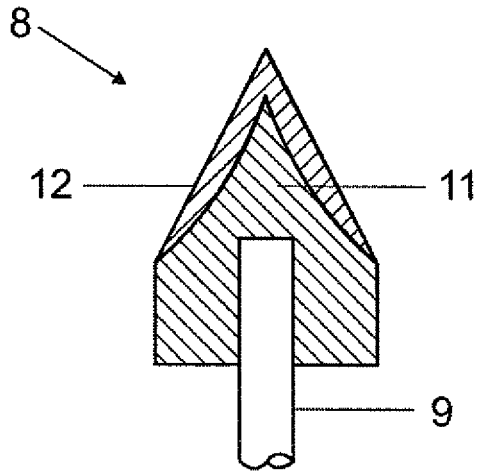

FIG. 6 shows an electrode 8 in which the head 10 tapers toward the tip in a cone shape. The base body 11 is made from tungsten. A layer 12 made from $YbB_6$ is applied on the inclined surface of the cone.

Important features of the invention, itemized in the form of a numbered list, are:

1. Electrode for a high-pressure discharge lamp, consisting of shaft and head mounted thereon, wherein at least a section of the head consists of ceramic material, characterized in that the ceramic material is a boride or carbide.
2. Electrode as claimed in claim 1, characterized in that at least one layer is arranged on a base body made from metal.
3. Electrode as claimed in claim 2, characterized in that the layer consists of at least one of the borides of La, Y, Yb or Ce or at least one of the carbides of Ta or Hf.
4. Electrode as claimed in claim 1, characterized in that the head is fabricated entirely from ceramic material.
5. Electrode as claimed in claim 2, characterized in that the layer is produced in accordance with a sol-gel technique.
6. Electrode as claimed in claim 4, characterized in that the shaft is also fabricated from ceramic material.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. An electrode for a high-pressure discharge lamp, comprising:

shaft and a head mounted thereon, wherein the head comprises a base body, wherein at least a section of the head comprises ceramic material, wherein the ceramic material is a mixture of Ta carbide and Hf carbide.

2. The electrode as claimed in claim 1, wherein at least one layer is arranged on the base body, the base body being made from metal.

3. The electrode as claimed in claim 2, wherein the layer consists of a mixture of Ta carbide and Hf carbide.

4. The electrode as claimed in claim 1, wherein the head is fabricated entirely from ceramic material.

5. The electrode as claimed in claim 2, wherein the layer is produced in accordance with a sol-gel technique.

6. The electrode as claimed in claim 4, wherein the shaft is also fabricated from ceramic material.

* * * * *